US006158776A

United States Patent [19]

Purcocks

[11] Patent Number: 6,158,776

[45] **Date of Patent: *Dec. 12, 2000**

[54] STATIONERY FILE

[76] Inventor: Dale McPhee Purcocks, 11 Alma Court, Alma Road, Monkstown, County Dublin, Ireland

[ * ] Notice: This patent is subject to a terminal disclaimer.

[21] Appl. No.: 09/293,415

[22] Filed: Apr. 16, 1999

Related U.S. Application Data

[63] Continuation-in-part of application No. 09/135,706, Aug. 18, 1998.

[30] Foreign Application Priority Data

Nov. 29, 1997 [GB] United Kingdom ..... 9725217
Feb. 23, 1999 [GB] United Kingdom ..... 9904075

[51] Int. Cl.[7] ..... B42D 1/00

[52] U.S. Cl. ..... 281/21.1; 281/15.1; 281/29

[58] Field of Search ..... 281/15.1, 21.1, 281/29, 36, 37, 46

[56] References Cited

U.S. PATENT DOCUMENTS 4,402,585 9/1983 Gardlund ..... 353/120
4,928,995 5/1990 Pickering et al. ..... 281/29
5,025,978 6/1991 Pacione ..... 229/1.5 R
5,052,872 10/1991 Hunder et al. ..... 412/6
5,601,312 2/1997 Funkhouser ..... 281/21.1

*Primary Examiner*—A. L. Wellington
*Assistant Examiner*—Monica Carter
*Attorney, Agent, or Firm*—Rodman & Rodman

[57] ABSTRACT

The folder comprises:

(a) a substantially flexible sheet-like body member comprising at least one cover sheet with a marginal band adjacent a longitudinal edge of the cover sheet, the marginal band having first and second opposed major faces;

(b) at least one flap member connected to the body member, the flap member being movable from a retracted position, in which access is permitted to the first and second faces of the marginal band, to a covering position in which the flap member substantially covers the first and second faces of the marginal band; and (c) means for bonding the at least one flap member in the covering position.

21 Claims, 4 Drawing Sheets

STATIONERY FILE

RELATED APPLICATIONS

The present application is a continuation-in-part application of U.S. Ser. No. 09/135,706 filed Aug. 18th, 1998.

BACKGROUND OF THE INVENTION

The present invention relates to a file for stationery or the like.

There are many different types of files (sometimes referred to as file covers or the like) available for containing and presenting sheets of paper or the like. Such files generally have jackets (typically with front and back cover sheets) within which paper or the like may be held, typically by securing means such as clips, rings, slides, plastics combs or adhesive bonding agents. Such securing means are generally highly visible and tend to look unsightly and unprofessional for presentation files or the like. Furthermore, the securing means in some such files of the prior art have the disadvantage that they do not always reliably secure all the contents of the file.

Prior art document U.S. Pat. No. 5,601,312 discloses a two-piece cover for binding a plurality of sheets. The front cover panel and the rear cover panel are formed of separate panels which are assembleable by securing the front cover panel to a stack of sheets by securing means. The rear cover panel includes an adhesive strip which adheres to the stack of sheets. A flap portion of the rear cover panel is then folded such that an adhesive strip thereon may secure the flap portion to the front cover panel so as to cover the securing means.

OBJECTS OF THE INVENTION

It is an object of the present invention to provide an improved file for stationery or the like.

It is a further object of the invention to provide an improved file having a flap member which may provide access to a marginal band of said file.

It is also an object of the invention to provide a file having a flap member which is movable to a position in which fastening means present in a margin region of the file may be covered.

SUMMARY OF THE INVENTION

The present invention provides a file which comprises:

(a) a substantially flexible sheet-like body member comprising at least one cover sheet with a marginal band adjacent a longitudinal edge of the cover sheet, the marginal band having first and second opposed major faces;

(b) at least-one flap member connected to the body member, the flap member being movable from a retracted position, in which access is permitted to the first and second faces of the marginal band, to a covering position in which the flap member substantially covers the first and second faces of the marginal band; and (c) means for bonding the at least one flap member in the covering position.

DESCRIPTION OF PREFERRED EMBODIMENTS

It is preferred that the marginal band adjacent a longitudinal edge of the cover sheet comprises a durable but penetrable material (penetrable by staples or the like).

According to a first embodiment of the present invention, the flexible sheet-like body member comprises a front cover sheet in addition to a back cover sheet.

Flexible sheet material (such as paper or the like) may be inserted into the file, typically in the form of a stack, such that an edge region of the sheet material is aligned with the marginal band. The flexible sheet material may be secured in the file by fastening means (such as staples or the like) applied substantially along the marginal band and through an edge region of the sheet material and, in certain circumstances, additionally through a portion of the flap member, all for example, using a stapling machine. The one or more flap members may then be moved from the retracted position to the covering position so as to cover first and second faces of the marginal band and any staple or staples (or other fastening means) which might otherwise be visible. The staple or staples or the like would be hidden or obscured by the flap member.

According to the present invention, the body member, forming part of the file, preferably comprises a unitary sheet of durable material (such as a suitable plastics material).

Furthermore, according to a further embodiment of the present invention, the body member may have two or more substantially median spinal folds, so as to form a spinal gusset between the front cover sheet and the back cover sheet. Such a gusset defines a space therebetween for receiving an edge region of a stack of sheet material. This arrangement permits more sheet material and/or thicker sheets to be secured in the file than in the arrangement in which one spinal fold is present.

A range of files according to the present invention may be produced with a corresponding range of spacings between such spinal folds. The size of the staples or other fastening means used may also be selected according to the number of, or thickness of, sheets to be secured in the file.

According to one embodiment of present invention, it is preferred that the file includes at least one crease line spaced from, and substantially parallel to, the spinal fold. Preferably, the crease line is formed on the front cover sheet so that the contents of the file may be viewed by folding the front cover sheet along the crease line. Typically, the crease line defines the border of the margin of the front cover sheet adjacent the spinal fold. Alternatively, there may be two crease lines, one at either side of the spinal fold (that is, there may be a crease line on both the front and back cover sheets).

The flap member of the file according to the present invention preferably comprises an elongate length of material, and is preferably of similar or same material as that of the body member. At least part of the flap member is affixed to the body member. The flap member is preferably opaque such that when the flap member is in the covering position, the margins, the spinal fold and any fastening means present along the margins are not visible through the flap member.

In one embodiment of the present invention, the flap member may comprise a first long edge which is permanently affixed to the front or back cover sheet and spaced apart from the margin of the front or back cover sheet (leaving both margins readily accessible), and a second long edge which comprises adhesive means for use when bonding the flap member to the body member.

The first long edge of the flap member is preferably permanently affixed to the body member by suitable (permanent) adhesive means, by welding or the like. The second long edge of the flap member comprises suitable adhesive means, such adhesive means being preferably of a permanent nature. Alternatively, the adhesive means may be such as to permit removable bonding of the flap member to the body member, thereby allowing the folder to be re-used.

The second long edge of the flap member may additionally comprise a strip of paper or the like covering the adhesive means. This strip may be removed (for example, peeled off) prior to moving the flap member from the retracted position in which access is permitted to both margins of the front and back cover sheets, to a covering position in which the flap member is adhesively attached to the body member and covers both margins of the front and back cover sheets. In the covering position, the second long edge of the flap member may be adhesively bonded to the margin, or to a portion of the respective cover sheet spaced from the margin.

According to another embodiment of the present invention, the first and second long edges of the flap member may comprise suitable adhesive means, and a substantially median portion of the flap member may be permanently affixed to the spinal fold of the body member substantially parallel to the two long edges of the flap member.

According to a further embodiment of the present invention, the file may comprise two such flap members, with the first long edge of one flap member being permanently affixed to the front cover sheet and the first long edge of the other flap member being permanently affixed to the back cover sheet. The first long edge of each such flap member is bonded to the respective cover sheet, but not to the respective margin, thereby leaving both margins accessible. The second long edge of each flap member typically comprises suitable adhesive means.

The file according to the first embodiment of the present invention permits access to both margins of the front and back cover sheets at the same time, so that, advantageously, fastening means (such as staples applied by a stapling machine) may be effectively used to fasten sheet material to both margins in one operation. Additional staples may be used to further secure the sheet material to the body member.

It is a preferred feature of the first embodiment of the present invention that the body member and the flap member are typically of a suitable plastics material. It is further preferred that the front and/or back cover sheets may be transparent. Alternatively, a portion only of the front sheet and/or of the back cover sheet may be transparent, so as to form a window or the like.

The present invention further comprises a method of producing a bound stack of paper or the like, which method comprises locating a stack of paper or the like in contact with a file according to the present invention (as described above) with an edge of the stack aligned with the marginal band; securing the stack to the file, while the flap member is in the retracted position, by securing means which penetrates the marginal band; moving the flap member to said covering position; and bonding the flap member in the covering position by the bonding means.

According to one embodiment of the present invention, a stack of papers or the like may be positioned on the flexible sheet-like body member so as to substantially cover the first major face of the marginal band. The stack of papers or the like may be secured to the body member by securing means (such as staples or the like) applied substantially along and through the (now covered) first major face of the marginal band, for example, using a stapling machine. The flap member may then be moved from the retracted position, in which access is permitted to the first and second faces of the marginal band, to the covering position in which the flap member substantially covers the first and second faces of the marginal band.

According to another embodiment of the present invention, the flap member may comprise a substantially elongate strip comprising two portions, one portion either side of at least one longitudinal fold line. It is a preferred feature of the present invention that a first portion of the flap member is connected to the marginal band of the body member and a second portion of the flap member is not connected to the marginal band. According to this embodiment of the present invention, the flap member is connected to the marginal band such that a stack of papers or the like may be inserted so as to rest alongside a spinal fold of the file formed at the meeting point of a longitudinal edge region of the marginal band and a longitudinal edge region of the flap member. The stack of paper or the like may then be secured in the file by securing means (such as staples or the like) applied substantially along the first portion of the flap member. The second portion of the flap member is then moved from the retracted position to the covering position in which the flap member substantially covers the second face of the marginal band of the file (the first face already being covered) and also covers staple or staples (or other fastening means) which might otherwise be visible.

Furthermore, according to a second embodiment of the present invention, the flap member of the stationery file may have two or more longitudinal fold lines, so as to form a spinal gusset. Such a gusset defines a space therebetween for receiving an edge region of a stack of papers. This arrangement permits more papers and/or thicker sheets of paper to be secured in the file than in the arrangement in which one spinal fold is present.

A range of files according to the present invention may be produced with a corresponding range of spacings between such spinal folds. The size of the staples or other securing means used may also be selected according to the number of, or thickness of, sheets to be secured in the file.

The flap member of the file, according to each of the embodiments of the present invention, preferably comprises an elongate length of material, and is preferably of similar or same material as that of the body member. At least part of the flap member is preferably affixed to the marginal band and/or the body member.

In a preferred embodiment of the present invention, the body member and the flap member are typically of suitable plastics material. According to the present invention, the body member (or a portion of the body member) may be transparent. It is preferred that the marginal band comprises a durable but penetrable material (penetrable by staples or the like).

In one embodiment of the present invention, the flap member may comprise a first longitudinal edge region which is permanently affixed to the marginal band, and a second longitudinal edge region which comprises adhesive means for use when adhesively bonding the flap member to the body member.

The first longitudinal edge region of the flap member is preferably permanently affixed to the body member by suitable (permanent) adhesive means, by welding or the like. The second longitudinal edge region of the flap member preferably comprises suitable adhesive means, such adhesive means being preferably of a permanent nature. Alternatively, the adhesive means may be such as to permit removable bonding of the flap member to the body member, thereby allowing the file to be re-used.

The second longitudinal edge region of the flap member may additionally comprise a strip of paper or the like covering the adhesive means. This strip may be removable (for example, by peeling off) prior to moving the flap member from the retracted position in which access is permitted to the first and second faces of the marginal band, to the covering position in which the flap member is adhesively bonded to the body member and/or marginal band.

According to a further embodiment of the present invention, the first and second longitudinal edge regions of the flap member may comprise suitable adhesive means, and a substantially median portion of the flap member may be permanently affixed to a longitudinal edge region of the marginal band of the body member of the file.

The file according to the present invention may be used with paper binders, clips, slides or the like, as fastening means in place of staples (all of which are preferably such that they penetrate the marginal band). Such a paper binder, clip or slide may then be hidden, as previously described, by covering the marginal band with the flap member.

DETAILED DESCRIPTION OF THE DRAWINGS

Figure 1:
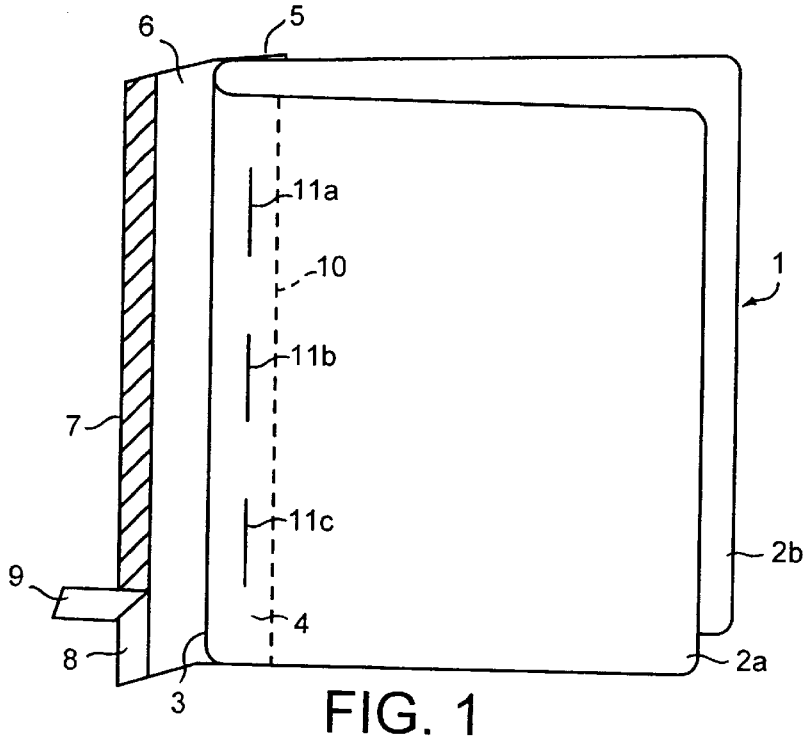
FIG. 1 (not to scale) is a schematic representation of a file according to the present invention, with front and back cover sheets and with a flap member permanently affixed to the body member.

Referring to FIG. 1, there is illustrated a file generally designated by reference numeral 1. The file 1 comprises a substantially flexible sheet like body member comprising a front 2*a* and back 2*b* cover sheet and having a substantially median spinal fold 3. The front cover sheet 2*a* has a margin 4 adjacent the spinal fold; the back cover sheet 2*b* also has a margin adjacent the spinal fold (not shown in the diagram). A first long edge 5 of elongate flap member 6 is permanently bonded to the back cover sheet 2*b* and spaced from the margin border.

A second long edge 7 of flap member 6 has an adhesive coating to bond the flap member 6 in the covering position to the front cover sheet 2*a*. In the covering position, the second long edge 7 is bonded within margin 4 or spaced from margin 4, so that the margins of the front and back cover sheets 2*a*,2*b* are covered. The second long edge 7 has an adhesive coating 8 concealed by a peelable strip 9; prior to bonding the flap member 6 to the front cover sheet 2*a*, the peelable strip is removed. The front cover sheet 2*a* has a crease line 10 defining the border of margin 4, which permits the cover sheet 2*a* to be folded along the crease line 10 to reveal the contents of the folder 1.

When sheet material is to be secured in the file, an edge region of the sheet material is aligned along the interior of the spinal fold. As illustrated in the diagram, the flap member 6 is in the retracted position, so as to permit access to both margins of the cover sheets 2*a*,2*b*, so that a stapling machine (for instance) may be used to fasten the sheet material to both margins of the cover sheets 2*a*,2*b*. In the arrangement shown in the diagram, three staples 11*a*,11*b*, 11*c* have been used to secure sheet material in file 1. The flap member 6 may subsequently be bonded in the covering position.

Figure 2:
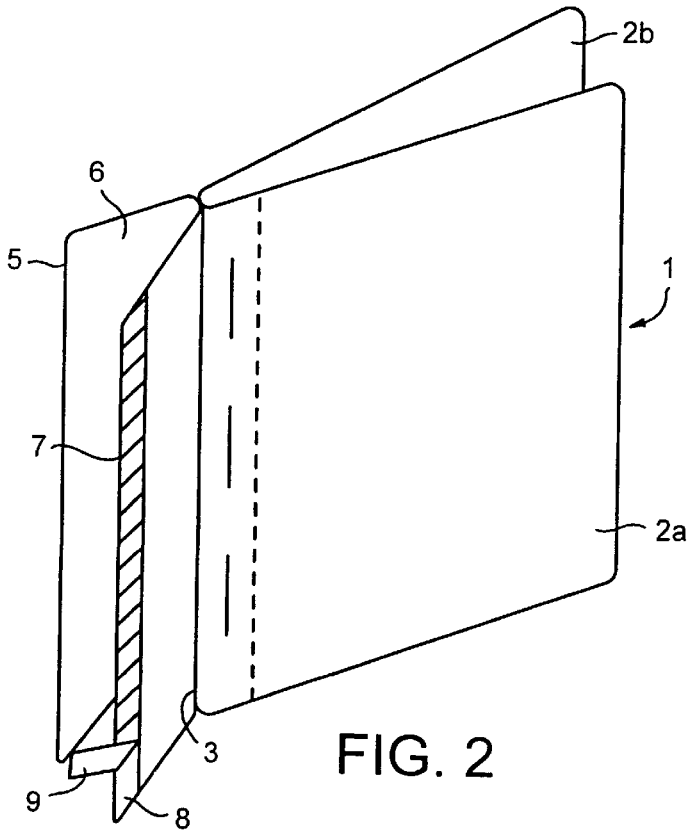
FIG. 2 is a schematic representation of a file according to the invention, also comprising front and back cover sheets, and with a substantially median portion of a flap member permanently affixed to the spinal fold of the body member.

Referring to FIG. 2, there is illustrated another embodiment of file 1 in which a substantially median portion of flap member 6 is permanently bonded to spinal fold 3 of the body member. The first and second long edges 5,7 of the flap member 6 are in a retracted position permitting access to both margins of cover sheets 2*a*,2*b*. The first and second long edges 5,7 comprise an adhesive coating 8 concealed by a peelable strip 9 (the strip is peeled away prior to use) to allow the first long edge 5 to be bonded to the front cover sheet 2*a* and the second long edge 7 to be bonded to the back cover sheet 2*b*. The long edges 5,7 are bonded within, or spaced from, the margins of the cover sheets 2*a*,2*b*.

Figure 3:
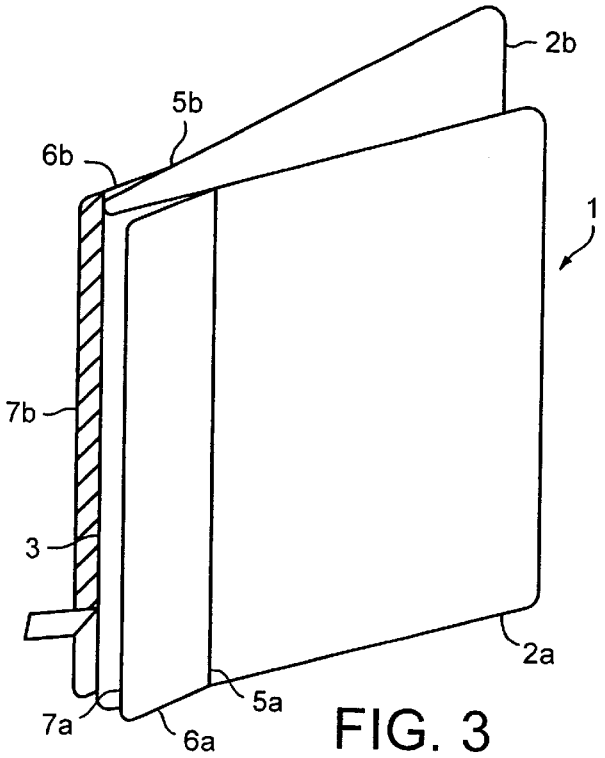
FIG. 3 is a schematic representation of one embodiment of a file according to the invention, with two flap members permanently affixed to the body member.

Referring to FIG. 3, there is illustrated a further embodiment of file 1. The file 1 comprises two flap members 6*a*,6*b*. Flap member 6*a* is permanently bonded to front cover sheet 2*a* along a first long edge 5*a*, and flap member 6*b* is permanently bonded to back cover sheet 2*b* along a first long edge 5*b*. The long edges 5*a*,5*b* are spaced apart from the margins. The second long edges 7*a*,7*b* of flap members 6*a*,6*b* comprise adhesive means to bond the flap members 6*a*,6*b* in the region of the spinal fold 3 to form the covering position.

Figure 4:
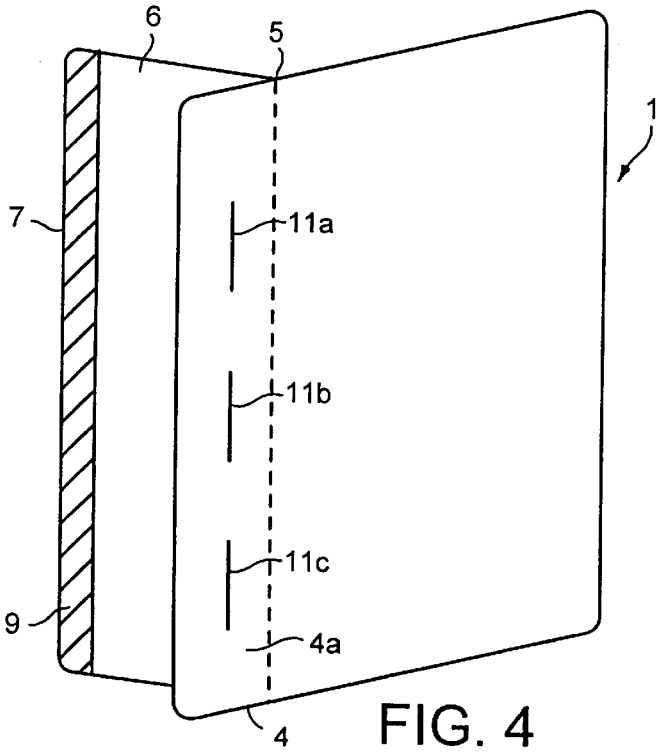
FIG. 4 is a schematic representation of a file according to the present invention with a back cover sheet only and flap member permanently affixed to the body member.

Referring to FIG. 4, there is illustrated a further embodiment of file 1. The file 1 comprises a substantially flexible sheet-like body member comprising a marginal band 4 having a first major face 4*a* and a second major face (not shown) on the obverse thereof. A first longitudinal edge region 5 of an elongate flap member 6 is permanently bonded to the back of body member and spaced from the marginal band 4. A second long edge 7 of the flap member 6 has an adhesive coating to bond the flap member 6 in a covering position so as to cover first and second opposed major faces of the marginal band 4. The second long edge 7 has an adhesive coating concealed by a peelable strip 9; prior to bonding the flap member 6 to the marginal band 4, the peelable strip 9 is removed.

When paper or the like is to be secured in the file of FIG. 4, an edge region of the paper is aligned with an edge region of the marginal band 4 so as to substantially conceal marginal band 4. As illustrated in the diagram, the flap member 6 is in the retracted position so as to permit access to the first and second opposed major faces of marginal band 4, so that a stapling machine (for instance) may be used to fasten the sheet material to the marginal band 4. In the arrangement illustrated in the diagram, three staples 11*a*, 11*b* and 11*c* have been used to secure sheet material in file 1. The flap 6 may subsequently be adhesively bonded in the covering position.

Figure 5:
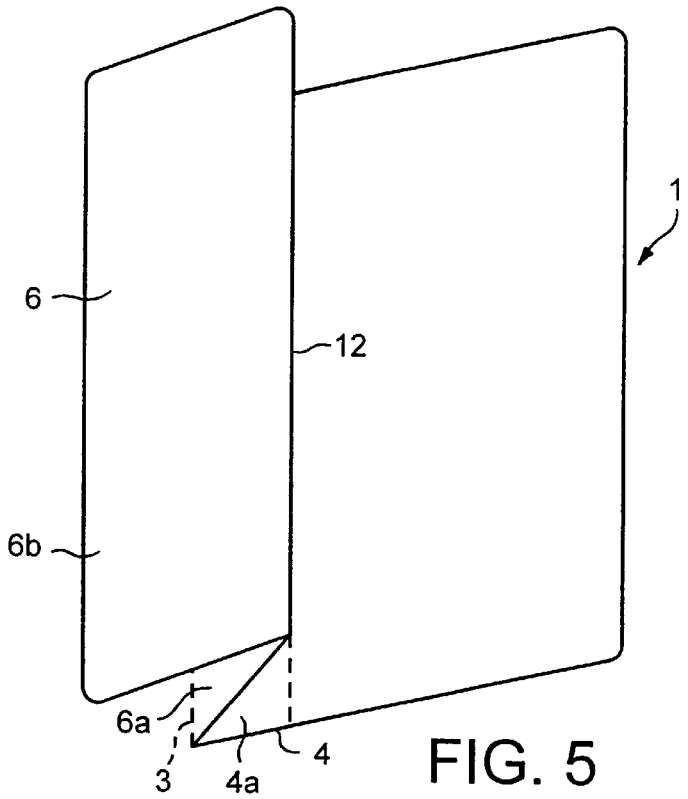
FIG. 5 is a schematic representation of a further embodiment of a file according to the invention with a flap member comprising a longitudinal fold line.

Referring to FIG. 5, there is illustrated another embodiment of the file according to the present invention. There is illustrated a folder 1 comprising a flap member 6 having two portions 6*a* and 6*b*, one either side of a longitudinal fold line 12. The first portion 6*a* of the flap member 6 is connected to an edge region of the marginal band 4 and the second portion 6*b* of the flap member 6 is not connected to an edge region of the marginal band. When the file shown in FIG. 5 is used, paper or other penetrable sheet material is inserted so as to rest alongside a spinal fold 3 of the file 1 formed at the meeting point of a longitudinal edge region of the marginal band 4 and a longitudinal edge region of the flap member 6. When paper or the like substantially covers the first major face 4*a* of the marginal band 4, the paper may be secured in the file by staples or the like applied substantially along the first portion 6*a* of the flap member 6. The second portion 6*b* of the flap member is then moved from a retracted position to a covering position in which the flap member substantially covers the opposed faces of the marginal band 4 of the file 1.

Figure 6:
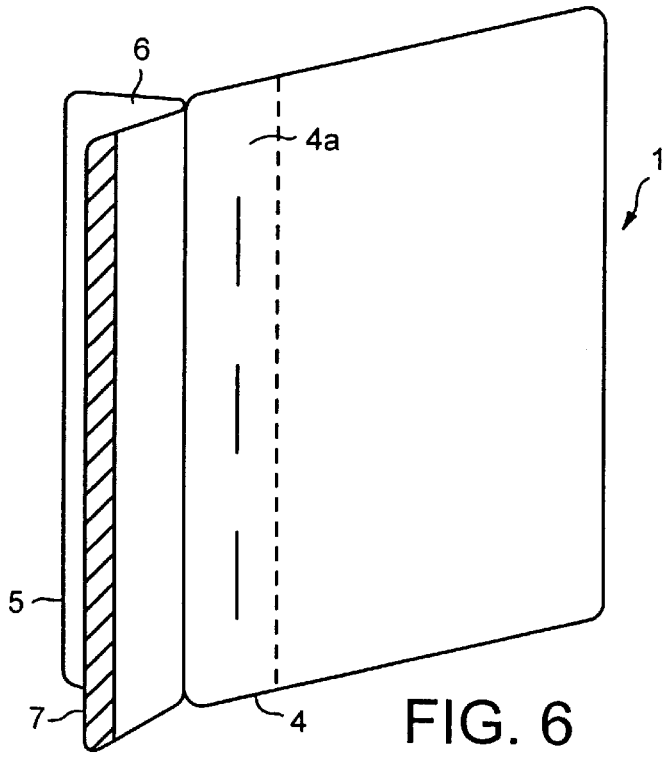
FIG. 6 is a schematic representation of a a file according to the present invention comprising a back cover sheet only and a substantially median portion of a flap member permanently affixed to a longitudinal edge region of the marginal band of the body member.

Referring to FIG. 6, there is illustrated another embodiment of the file according to the present invention. According to this embodiment, there is illustrated a file 1 in which a substantially median portion of the flap member 6 is permanently bonded to an edge region of marginal band 4. The first longitudinal edge region 5 and second longitudinal edge region 7 of the flap member 6 are in a retracted position permitting access to face 4*a* and the obverse face (not shown) of marginal band 4. The first 5 and second 7 longitudinal edge regions comprise an adhesive coating concealed by a peelable strip (the strip is peeled away prior to use) to allow the first longitudinal edge region to be adhesively bonded to the obverse face of the marginal strip and the second longitudinal edge region to be bonded to the face 4*a* of the marginal band 4.

Figure 7:
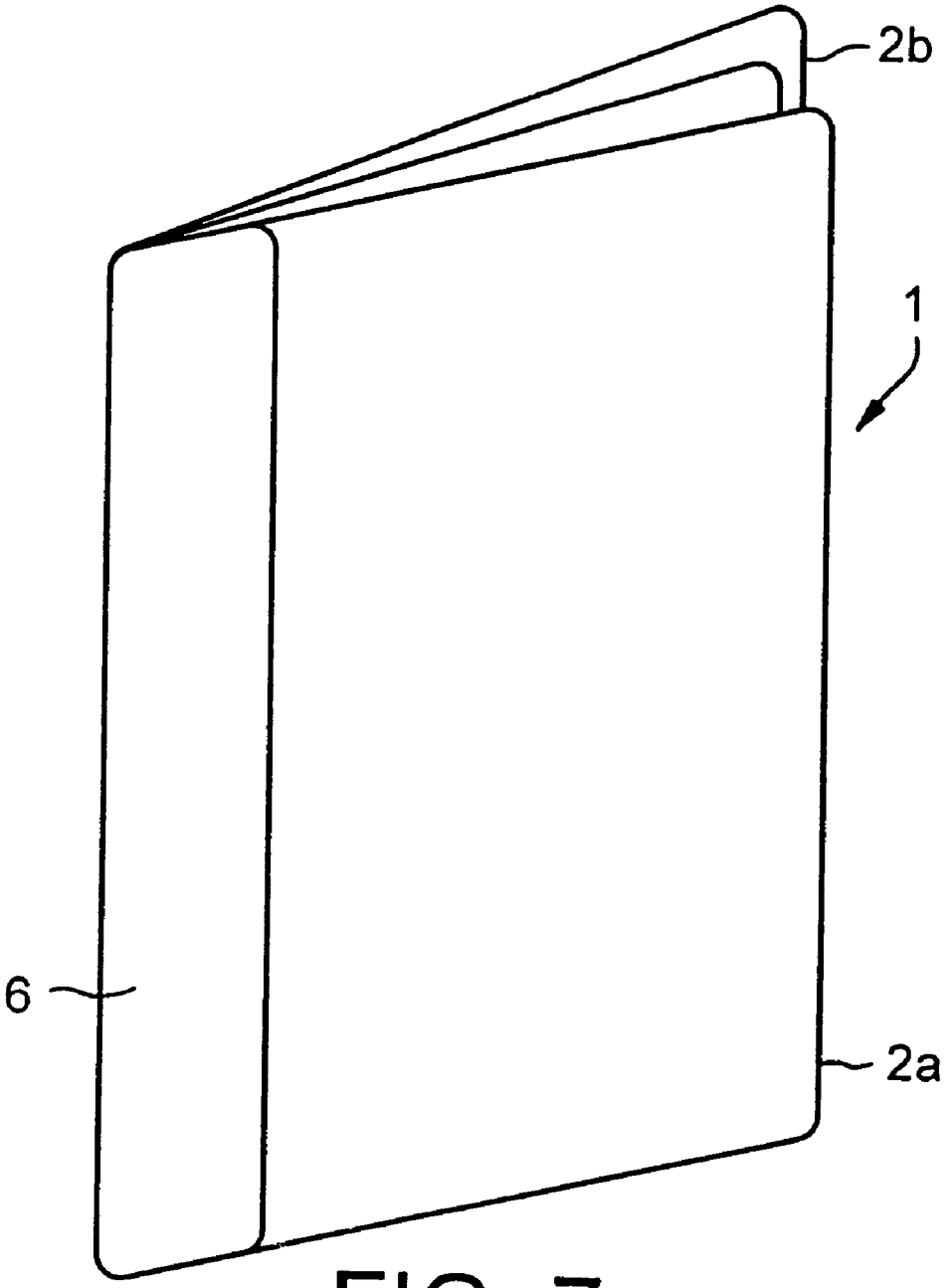
FIG. 7 is a schematic representation of a file with the flap member in a covering position.

Referring finally to FIG. 7, there is illustrated a file 1 in which the flap member 6 is in the covering position covering the margin of cover sheet 2*b* and/or cover sheet 2*a*. Alternatively, if the file according to FIG. 4, 5 or 6 is used, the front sheet of paper secured in the file comprises front cover sheet 2*a*. The opacity of the flap member ensures that staples 11*a*,11*b*,11*c* are obscured.

I claim:

1. A file which comprises;

(a) a substantially flexible sheet-like body member comprising at least one cover sheet with a marginal band adjacent a longitudinal edge of the cover sheet, the marginal band having first and second opposed major faces for receiving fastening means on or through the first and second opposed major faces to fasten one or more pieces of sheet material to said cover sheet;

(b) at least one flap member connected to the body member, the flap member being movable from a retracted position, in which access is permitted to the first and second opposed major faces of the marginal band, to a covering position in which the flap member substantially covers the first and second opposed major faces of the marginal band and all portions of the fastening means on the first and second opposed major faces to conceal the fastening means; and (c) means for bonding the at least one flap member in the covering position.

2. A file according to claim 1, wherein said marginal band comprises a durable, penetrable material.

3. A file according to claim 1, wherein said body member comprises a unitary sheet of durable material.

4. A file according to claim 3, wherein said durable material comprises a plastics material.

5. A file according to claim 1, wherein said body member comprises a front cover sheet and a back cover sheet, said front cover sheet and said back cover sheet being separated by a substantially median spinal fold.

6. A file according to claim 5, wherein said body member comprises at least two substantially median spinal folds, so as to form a spinal gusset between said front cover sheet and said back cover sheet.

7. A file according to claim 5, wherein said body member comprises at least one crease line spaced from, and substantially parallel to, said spinal fold.

8. A file according to claim 7, wherein said crease line is formed on the front cover sheet.

9. A file according to claim 5, wherein at least a portion of at least one of said cover sheets is transparent.

10. A file according to claim 1, wherein said flap member comprises an elongate length of substantially flexible, durable and penetrable material comprising a first long edge and a second long edge.

11. A file according to claim 1, wherein said flap member comprises a plastics material.

12. A file according to claim 1, wherein said flap member is substantially opaque.

13. A file according to claim 10, wherein at least a part of said flap member is affixed to said body member, and wherein at least one long edge of said flap member is provided with adhesive means.

14. A file according to claim 13, wherein said adhesive means is such as to bond said flap member to said body member.

15. A file according to claim 13, wherein said adhesive means is covered by a peelable strip of paper.

16. A file according to claim 10, wherein said first long edge of said flap member is affixed to said body member by adhesive means and wherein said second long edge is provided with adhesive means.

17. A file according to claim 10, wherein said first and second long edges of the flap member are provided with adhesive means and wherein a substantially median portion of the flap member is affixed to a spinal region of the body member.

18. A file according to claim 1, wherein said flap member comprises an elongate strip comprising two portions, one either side of a longitudinal fold line.

19. A file according to claim 18, wherein a first portion of said flap member is connected to the marginal band of the body member and wherein said second portion of said flap member is not connected to said marginal band.

20. A method of producing a bound stack of flexible sheet material, which method comprises:

(a) locating a stack of paper in contact with a file according to claim 1 with an edge of the stack aligned with said marginal band;

(b) securing said stack to said file, while said flap member is in said retracted position, by securing means which penetrates or grips onto said marginal band;

(c) moving said flap member to said covering position to conceal said securing means; and (d) bonding said flap member in said covering position by said bonding means.

21. A method according to claim 20, wherein said securing means comprises at least one staple, paper binder, clip or slide which penetrates or grips onto said marginal band.

* * * * *